US009017141B2

(12) United States Patent
Lowe

(10) Patent No.: US 9,017,141 B2
(45) Date of Patent: Apr. 28, 2015

(54) DEBURRING MACHINE AND METHOD FOR DEBURRING

(71) Applicant: White Drive Products, Inc., Hopkinsville, KY (US)

(72) Inventor: Gary Dean Lowe, Tennessee Ridge, TN (US)

(73) Assignee: White Drive Products, Inc., Hopkinsville, KY (US)

( * ) Notice: Subject to any disclaimer, the term of this patent is extended or adjusted under 35 U.S.C. 154(b) by 210 days.

(21) Appl. No.: 13/734,265

(22) Filed: Jan. 4, 2013

(65) Prior Publication Data

US 2014/0194038 A1 Jul. 10, 2014

(51) Int. Cl.
*B24B 9/04* (2006.01)

(52) U.S. Cl.
CPC ..... *B24B 9/04* (2013.01)

(58) Field of Classification Search
USPC ..... 451/28, 51, 59, 57, 334, 11
See application file for complete search history.

(56) References Cited

U.S. PATENT DOCUMENTS 2,375,333 A 5/1945 Troendly
3,112,851 A * 12/1963 Collins ..... 225/4
3,473,181 A * 10/1969 Leonard ..... 15/77
3,780,407 A * 12/1973 Hoffecker ..... 29/90.01
4,373,297 A * 2/1983 Pennertz et al. ..... 451/200
4,478,009 A * 10/1984 Rukavina et al. ..... 451/14
5,105,583 A * 4/1992 Hammond et al. ..... 451/271
5,975,997 A 11/1999 Minami
6,213,843 B1 4/2001 Kramer
6,726,525 B1 4/2004 Kato et al.
2001/0034195 A1 10/2001 White
2004/0097167 A1 5/2004 Yamada
2011/0300785 A1* 12/2011 Fries ..... 451/267

OTHER PUBLICATIONS

International Search Report filed in PCT/US2013/054066.

* cited by examiner

*Primary Examiner* — Robert Rose
(74) *Attorney, Agent, or Firm* — Rankin, Hill & Clark LLP

(57) ABSTRACT

A method for deburring a ground metal part includes loading a ground metal part into a carrier, contacting a first planar surface of the ground metal part with a first grinding wheel, and contacting a second planar surface of the ground metal part with a second grinding wheel. The first grinding wheel is rotated in a first rotational direction. The second grinding wheel is rotated also in the first rotational direction. After the first grinding wheel is rotated in the first rotational direction, the first grinding wheel is then rotated in a second rotational direction, which is opposite to the first rotational direction. After the second grinding wheel is rotated in the first rotational direction, the second grinding wheel is also rotated in the second rotational direction.

19 Claims, 11 Drawing Sheets

DEBURRING MACHINE AND METHOD FOR DEBURRING

BACKGROUND

Flat surfaces of metal parts can be ground by a grinding wheel to improve the flatness of the flat surface. Such grinding operations can result in metal burrs being formed from material that has been removed from the ground metal part during the grinding process. It is desirable to remove these burrs from the ground metal part.

One known method for removing burrs from the ground metal part includes placing the ground metal part into a tumbling device and allowing the ground metal part to tumble within the device thus knocking the burrs from the ground metal part. This method of deburring ground metal parts, however, may nevertheless still not remove all the burrs from a ground metal part, especially a ground metal part in which a passage is formed beginning in the ground flat surface.

SUMMARY

A method for deburring a ground metal part that can overcome at least one of the aforementioned shortcomings includes loading a ground metal part into a circular opening in a carrier of a deburring machine, contacting a first planar surface of the ground metal part with a first grinding wheel, and contacting a second planar surface, which is opposite to and parallel with the first planar surface, of the ground metal part with a second grinding wheel. With the first grinding wheel in contact with the first planar surface, the first grinding wheel is then rotated in a first rotational direction about a first rotational axis, which is parallel to and offset from a central axis of the circular opening. With the second grinding wheel in contact with the second planar surface, the second grinding wheel is rotated also in the first rotational direction about a second rotational axis, which is parallel to and offset from the central axis of the ground metal part. After the first grinding wheel is rotated in the first rotational direction and with the first grinding wheel in contact with the first planar surface, the first grinding wheel is then rotated in a second rotational direction, which is opposite to the first rotational direction, about the first rotational axis. After the second grinding wheel is rotated in the first rotational direction and with the second grinding wheel in contact with the second planar surface, the second grinding wheel is also rotated in the second rotational direction about the second rotational axis. The changing of the rotational direction of each grinding wheel can be repeated to remove burrs from the ground metal part, especially from within passages in the ground metal part.

DETAILED DESCRIPTION

Figure 1:
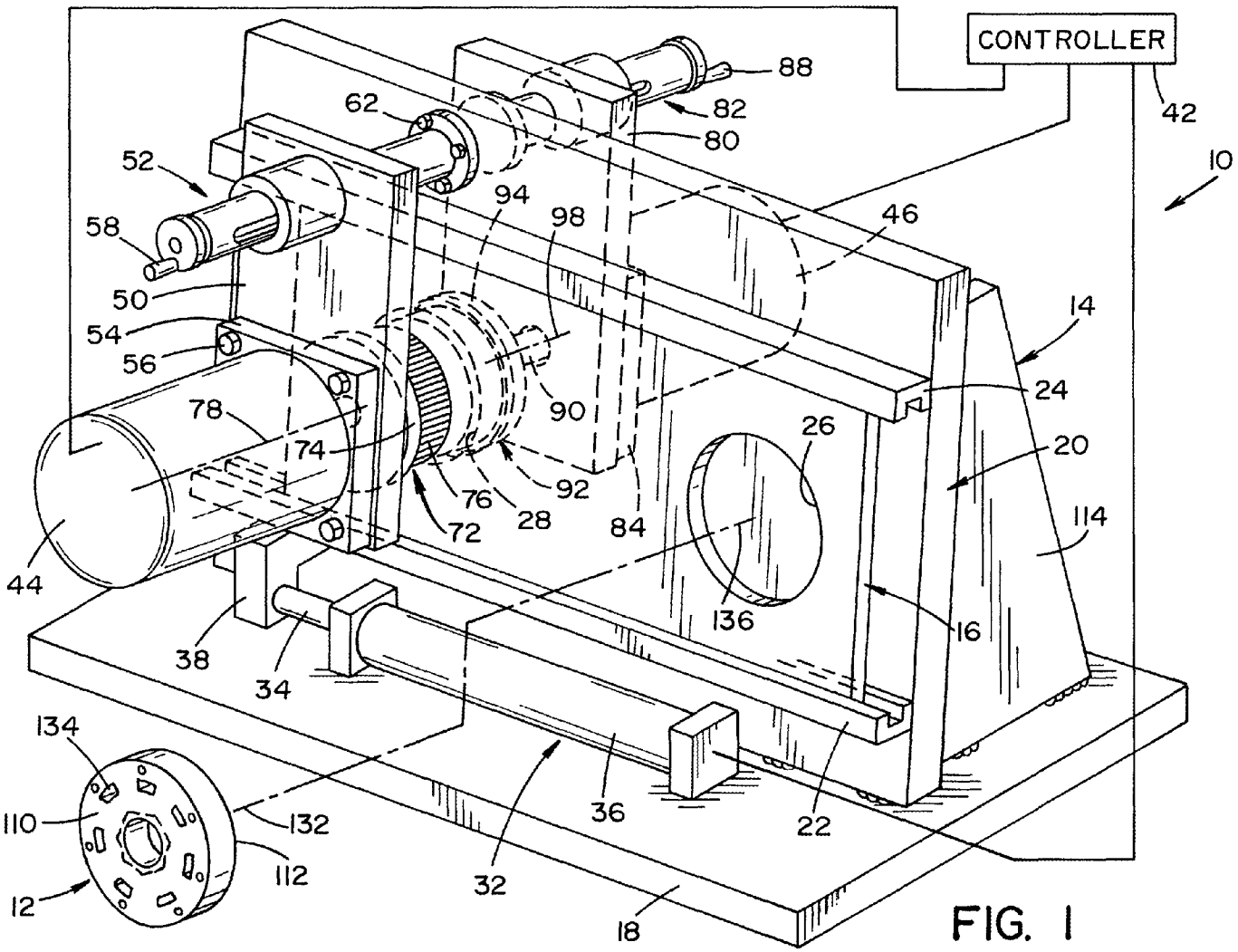
FIG. 1 is a schematic perspective view of a deburring machine for use in a method for deburring a ground metal part.

FIG. 1 depicts a deburring machine 10 for deburring a ground metal part 12. The deburring machine 10 includes a frame 14 and a carrier 16 that is moveable with respect to the frame 14. The ground metal part 12 is loaded into the carrier 16 during the deburring operation (see FIG. 2). The deburring operation is performed after the ground metal part 12 has been ground in a grinding machine (not shown), which can result in the formation of burrs on the ground metal part 12. The deburring machine 10 is used to remove these burrs from the ground metal part 12 after the ground metal part 12 has already been ground in the grinding machine.

The frame 14 of the deburring machine includes a base 18 and an upwardly extending frame plate 20, which extends upwardly (and nearly vertically—see FIG. 3) from and is connected with the base 18. A lower rail 22 and an upper rail 24 connect with and are fixed to the frame plate 20. The carrier 16 rides along the rails 22, 24 offset from the frame plate 20. The carrier 16 translates between a loading position (shown in FIG. 1) and a grinding position (shown in FIG. 2). The carrier 16 includes a circular opening 26 that extends entirely through the carrier 16, which can be in the form of a metal plate. The frame plate 20 also includes an opening 28 (shown in phantom in FIG. 1). When the carrier 16 is in the grinding position (shown in FIG. 2), the opening 26 formed in the carrier 16 overlaps with the opening 28 formed in the frame plate 20.

A carrier drive 32 is provided to move the carrier 16 with respect to the frame 14. As illustrated, the carrier drive 32 includes a rod 34 and a cylinder 36. An arm 38 connects the rod 34 to the carrier 16. A controller 42 (depicted schematically in FIG. 1) communicates with the cylinder 36 to control operation of the cylinder 36, which controls movement of the rod 34 and thus movement of the carrier 16 with respect to the frame 14. Even though a rod and piston cylinder drive mechanism is depicted as the carrier drive 32, other known drive mechanisms can be employed for moving the carrier 16 with respect to the frame 14.

The deburring machine 10 also includes a first motor 44 positioned on a first side of the frame plate 20 and a second motor 46 positioned on an opposite side of the frame plate 20. Each of the motors 44, 46 is in communication with the controller 42 to control operation (e.g., ON/OFF, rotational direction) of the motors 44, 46.

Figure 3:
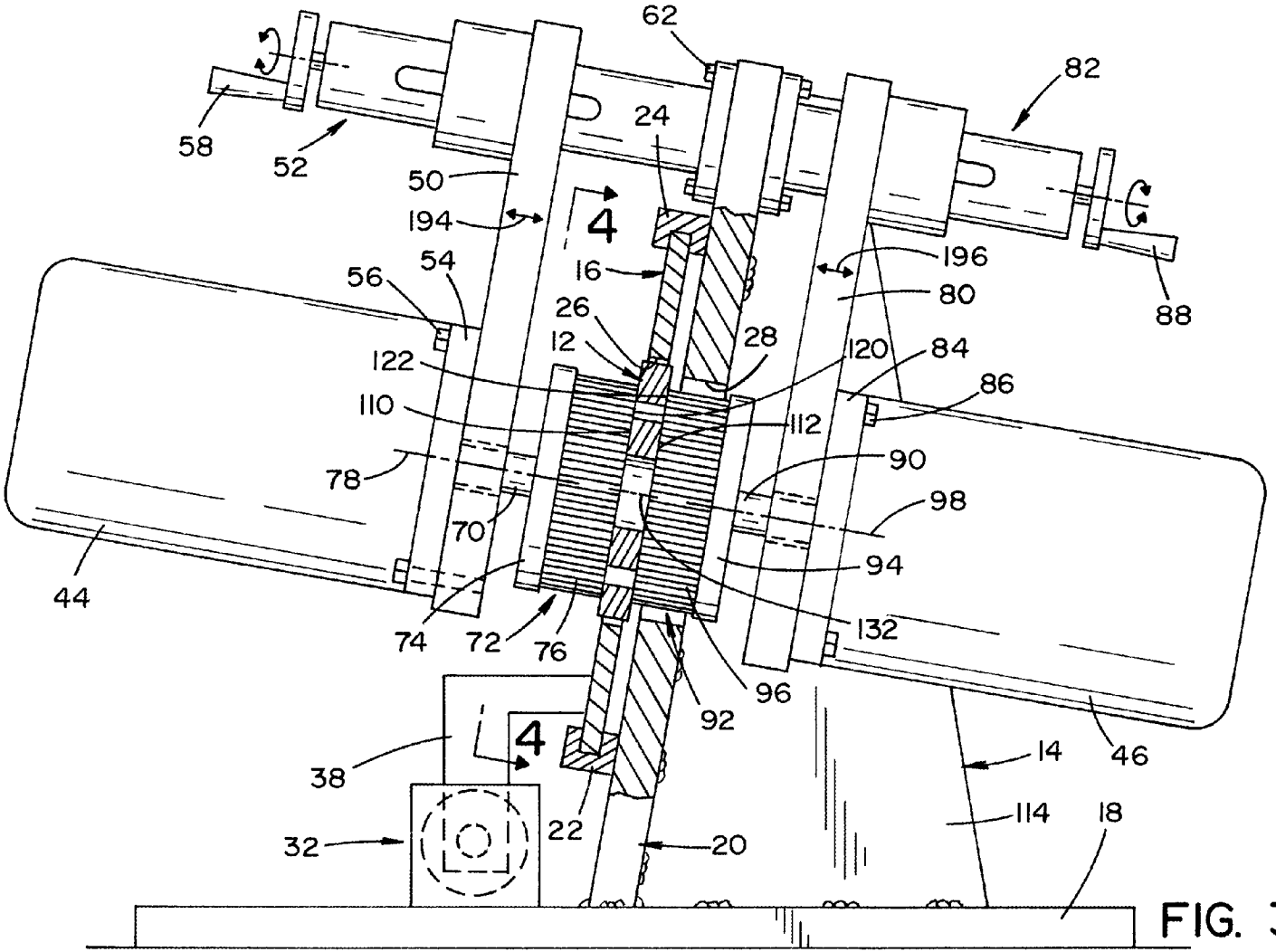
FIG. 3 is a side view, partially in cross-section, of the deburring machine as depicted in FIG. 2.

A first motor mount 50 connects with the frame 14, and more particularly the frame plate 20, through a first motor adjustment drive 52. The first motor 44 connects with the first motor mount 50 through a mounting plate 54 and a plurality of fasteners 56. The first motor adjustment drive 52 includes a handle 58 that can be manipulated by an operator of the deburring machine 10. The motor adjustment drive 52 attaches with the frame plate 20 using a plurality of fasteners 62, however, the motor adjustment drive mechanism 52 can attach in other conventional manners to the frame plate 20. With reference to FIG. 3, the first motor 44 includes an output shaft 70. A first grinding wheel 72, which includes a circular base 74 and a plurality of bristles 76 extending from the circular base 74, attaches to the output shaft 70. The first grinding wheel 72 rotates about a first rotational axis 78 (clockwise or counterclockwise) when the first motor 44 is ON. The first rotational axis 78 is generally horizontal (offset slightly from horizontal in the illustrated embodiment).

The second motor 46 connects with a second motor mount 80. The second motor mount 80 connects with the frame 14, and more particularly the frame plate 20, through a second motor adjustment drive 82. The second motor 46 connects with the second motor mount 80 through a mounting plate 84 and a plurality of fasteners 86. The second motor adjustment drive 82 also includes a handle 88 that can be manipulated by an operator of the deburring machine 10. The second motor 46 includes an output shaft 90 that connects with a second grinding wheel 92. The second grinding wheel 92 can have the same construction as the first grinding wheel 72 and include a circular base 94 and a plurality of bristles 96 that extend from the circular base 94. The second grinding wheel 92 rotates about a second rotational axis 98 (clockwise or counterclockwise) when the second motor 46 is ON. The second rotational axis 98 is generally horizontal (offset slightly from horizontal in the illustrated embodiment). The second grinding wheel 92 also extends through the opening 28 in the frame plate 20.

With reference back to FIG. 2, the carrier 16 is shown in a position that locates the ground metal part 12 in an appropriate location for deburring the ground metal part 12. In this position, the first grinding wheel 72 contacts the first planar surface 110 of the ground metal part 12, and as seen in FIG. 3, the second grinding wheel 92 contacts a second planar surface 112 of the ground metal part 12. Shields 114 can be provided on sides of the deburring machine 10 to contain material removed by the grinding wheels 72, 92 within a confined space or volume.

Figure 5:
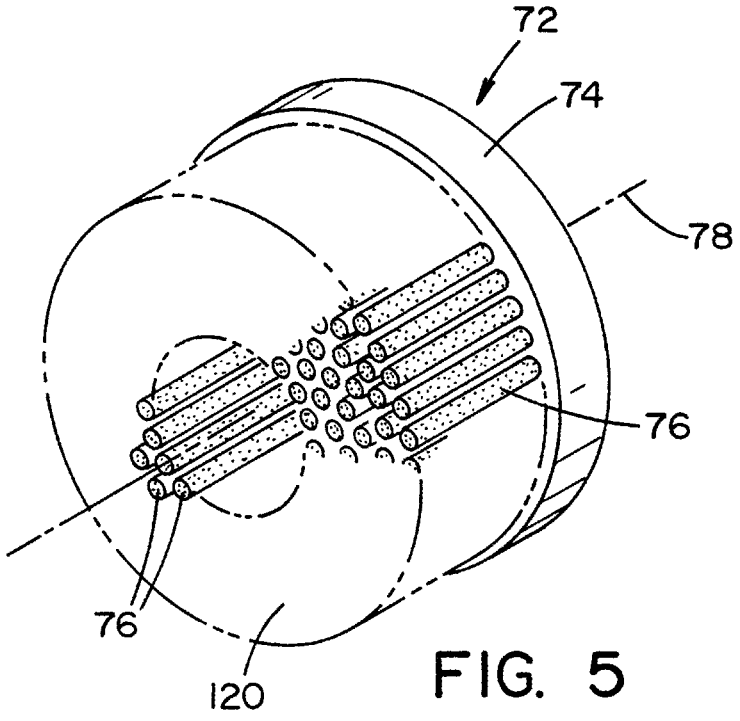
FIG. 5 is a perspective view of a grinding wheel for use with the deburring machine depicted in FIG. 1.

FIG. 5 depicts the first grinding wheel 72. It is to be understood that the second grinding wheel 92 can have the same configuration. The first grinding wheel 72 includes the circular base 74, which is coaxial with the first rotational axis 78. Each bristle 76 of the plurality of bristles extends from the circular base 74 in a direction generally parallel with the rotational axis 78. The bristles 76 can be made from a plastic material impregnated with carbon-boron-nitride (CBN) material. The bristles 76 can also be silicon carbide, nylon bristles coated with ceramic or another durable material capable of removing burrs from ground metal parts. Distal ends of the bristles 76 define a substantially planar first grinding surface 120 for contacting the first planar surface 110 of the ground metal part 12. The second grinding wheel 92 defines a similar planar grinding surface 122 (FIG. 3). With reference back to FIG. 5, each of the bristles 76 is flexible to allow each distal end to displace with respect to the circular base 74 when contacting the ground metal part 12.

Figure 6:
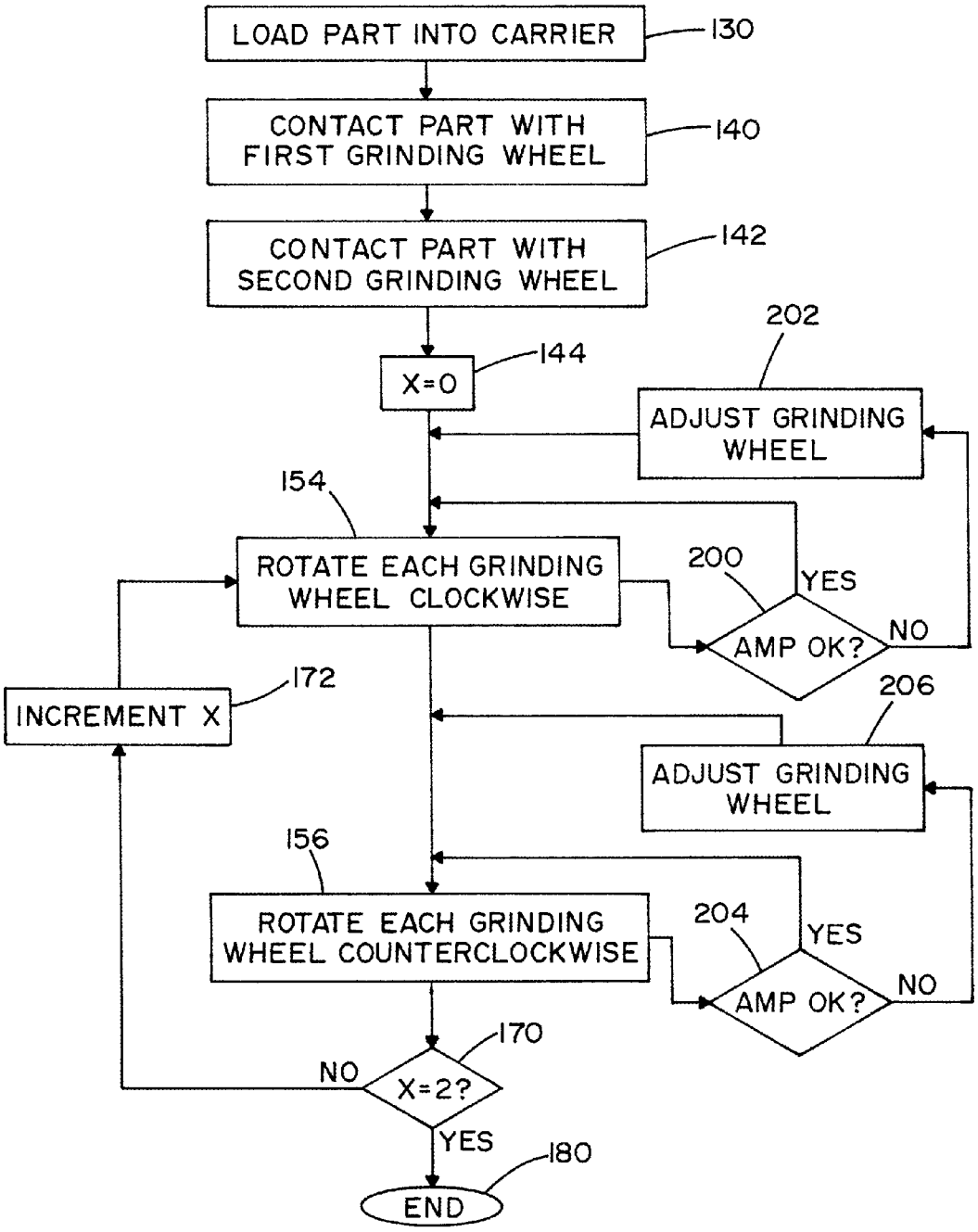
FIG. 6 is a flow diagram depicting a method for deburring a ground metal part.

A method for deburring a ground metal part, such as the ground metal part 12 depicted in FIG. 1, will be described with reference to the deburring machine 10 shown in FIGS. 1-4 and a flowchart depicted in FIG. 6. Even though the method will be described in a particular order and the flowchart in FIG. 6 depicts steps of the method in a particular order, the order in which the steps are described or depicted in FIG. 6 should not be found to limit the invention. Instead, some steps could be performed simultaneously with others while other steps could be performed before others even though these steps are depicted later in FIG. 6 or described later with the description of the method for deburring a ground metal part.

Figure 2:
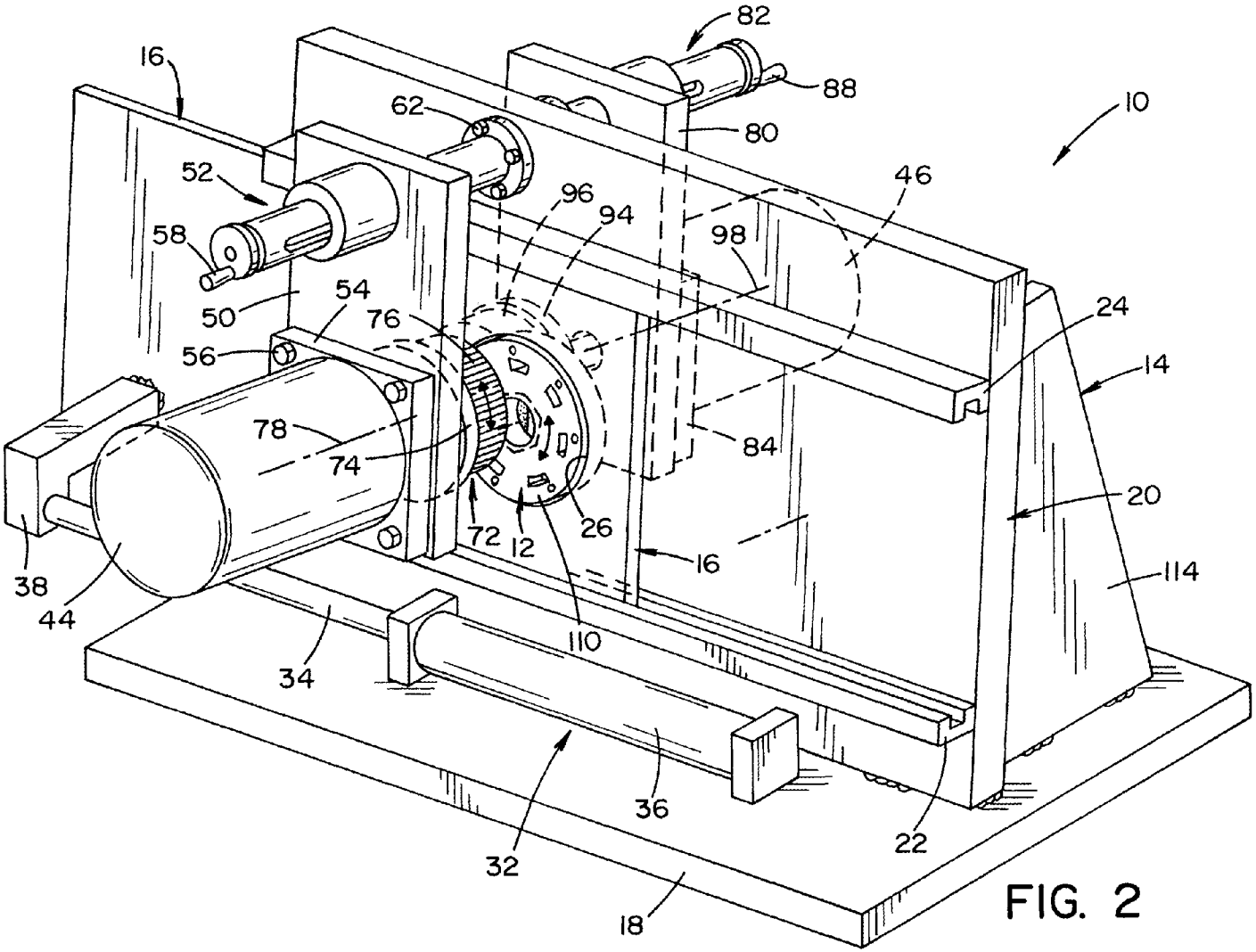
FIG. 2 is a schematic depiction of the deburring machine of FIG. 1 showing the deburring of a ground metal part during a deburring operation.

The method for deburring the ground metal part 12 includes loading the ground metal part 12 into the carrier 16, at 130 (FIG. 6). This is also shown in FIGS. 1 and 2. The ground metal part 12 has already undergone a grinding operation in which the first planar surface 110 and the second planar surface 112 has been ground in a grinding machine (not shown). As illustrated in FIGS. 1-4, the ground metal part 12 is circular in a cross-section taken normal to a central axis 132 of the ground metal part 12. The ground metal part 12 includes a recess 134 (a plurality of recesses are shown) extending axially into the ground metal part 12 from the first planar surface 110 toward and through the ground metal part 12 to the second planar surface 112. The ground metal part 12 depicted in FIG. 1 is a manifold of a hydraulic motor; however, the method for deburring ground metal parts is not limited only to manifolds for hydraulic motors. By employing grinding wheels 72, 92 having bristles 76, 96 in the method for deburring the ground metal part 12, distal sections of each of the bristles 76, 96 can extend into the recesses 134 of the ground metal part 12 to remove burrs that may have formed and lodged into these recesses 134 during the previous grinding operation. When forming metal parts, such as manifolds for hydraulic motors, the first planar surface 110 and the second planar surface 112 are typically ground to further ensure the flatness of the first planar surface 110 and the second planar surface 112. These respective planar surfaces 110, 112 will contact other plates in the hydraulic motor, and a flat surface is important to limit leakage of hydraulic fluid from the motor during operation of the motor. During the grinding operation, however, burrs can be formed. These burrs can get into the recesses 134 of the ground metal part 12 thus obstructing flow of hydraulic fluid, or the burrs could become dislodged from the manifold within the hydraulic motor and damage the hydraulic system.

FIG. 1 depicts the ground metal part 12 as having a circular configuration. As will be described in more detail below, the deburring machine 10 can be used to deburr ground metal parts having a non-circular periphery. These parts, like the ground metal part 12, are loaded into the circular opening 26 in the carrier 16. The central axis of the ground metal part, similar to the central axis 132 of the ground metal part 12, aligns with a central axis 136 of the circular opening 126 in the carrier 16.

The method for deburring the ground metal part 12 further includes contacting the first planar surface 110 of the ground metal part 12 with a first grinding wheel 72, as depicted at 140 in FIG. 6. The method further includes contacting the second planar surface 112, which is opposite to and parallel with the first planar surface 110, of the ground metal part 12 with the second grinding wheel 92, which is depicted at 142 in FIG. 6. Some steps of the method for deburring the ground metal part 12 can be repeated, and therefore, at 144, increment "x" can be set to zero.

Figure 4:
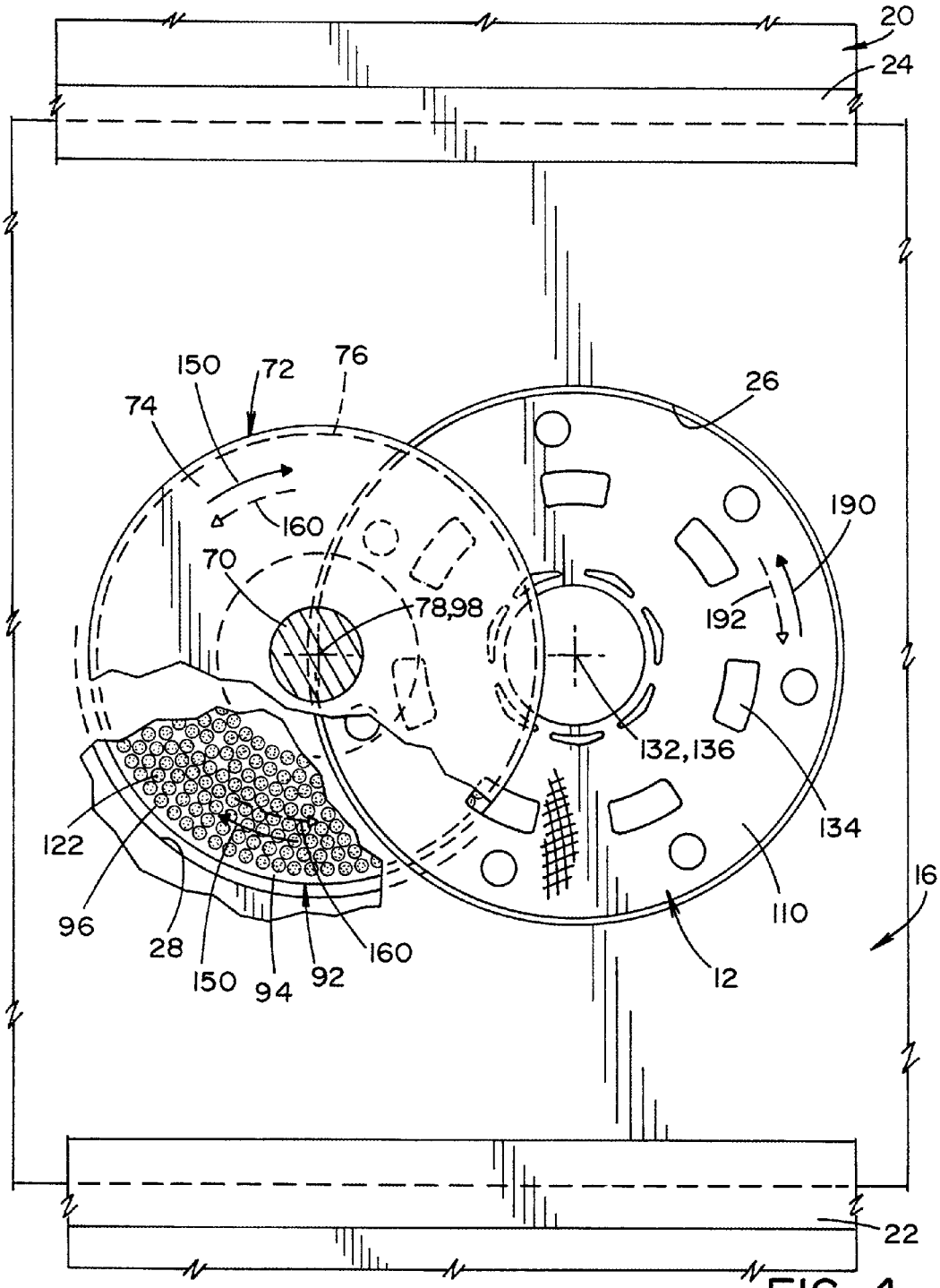
FIG. 4 is a view taken along line 4-4 in FIG. 3.

With reference to FIG. 4, with the first grinding wheel 72 in contact with the first planar surface 110 of the ground metal part 12, the first grinding wheel 72 is rotated in a first rotational direction (clockwise in FIG. 4) as depicted by arrow 150. Similarly, with the second grinding wheel 92 in contact with the second planar surface 112 of the ground metal part, the second grinding wheel 92 can also be rotated in the first rotational direction (clockwise in FIG. 4) as shown by arrow 150. With reference back to FIG. 6, each grinding wheel 72, 92 (FIG. 4) can be rotated clockwise, at 154. With continued reference to FIG. 6, at 156, each grinding wheel 72, 92 (FIG. 4) can be rotated counterclockwise. With reference back to FIG. 4, with the first grinding wheel 72 in contact with the first planar surface 110, the first grinding wheel 72 can then be rotated in a second rotational direction (counterclockwise in FIG. 4) as depicted by arrow 160 about the first rotational axis 78. Likewise, with the second grinding wheel 92 in contact with the second planar surface 112 of the ground metal part 12, the second grinding wheel 92 can be rotated in the second rotational direction (counterclockwise in FIG. 4) as depicted by arrow 160 about the second rotational axis 98. With reference back to FIG. 6, after each grinding wheel has been rotated clockwise, at 154, and then counterclockwise, at 156, then a decision can be made at 170 as to whether "x" equals a predetermined number, such as 2. If "x" has not reached the predetermined number, then "x" can be incremented at 172, and then rotation of each grinding wheel can resume at 154 and 156. If "x" is equal to the predetermined number, then the method for deburring the ground metal part can conclude, at 180, and the ground metal part 12 can be unloaded from the deburring machine 10.

With reference to FIG. 4, rotating the first grinding wheel 72 and the second grinding wheel 92 in the first rotational direction (arrow 150) with each grinding wheel 72, 92 in contact with the ground metal part 12, results in the ground metal part 12 rotating in a second rotational direction (with respect to the grinding wheels 72, 92, e.g., counterclockwise) as depicted by arrow 190 about the central axis 132 with respect to the carrier 16. Similarly, rotating the first grinding wheel 72 and the second grinding wheel 92 in the second rotational direction (arrow 160) with each grinding wheel 72, 92 in contact with the ground metal part 12, results in the ground metal part 12 rotating in the first rotational direction (counterclockwise) as depicted by arrow 192 about the central axis 132 with respect to the carrier 16.

With reference back to FIG. 1, the opening 26 in the carrier 16 is circular and slightly larger in diameter than the diameter of the ground metal part 12. With reference back to FIG. 4, the first rotational axis 78, about which the first grinding wheel 72 rotates, is offset from and parallel to central axis 132 of the ground metal part 12 and the central axis 136 of the opening 26. Similarly, the second rotational axis 98, about which the second grinding wheel 92 rotates, is also offset from and parallel to the central axes 132, 136. The first and second rotational axes 78, 98 are coaxial and are offset equidistant in a horizontal direction from the central axes 132, 136. By offsetting the rotation axes 78, 98 from the central axes 132, 136 and by providing a circular hole 26 in a carrier 16, the ground metal part 12 is capable of rotating within and with respect to the carrier 16 when the grinding wheels 72, 92 contact the ground metal part 12. With reference to FIG. 4, the location of each rotational axis 78, 98 of the respective grinding wheels 72, 92 with respect to the central axes 132, 136 and the radius of each grinding wheel 72, 92 is large enough so that the entire surface area of each planar surface 110, 112 is contacted by the respective grinding wheels 72, 92 as the ground metal part 12 rotates within the carrier 16.

With reference back to FIG. 1, the first motor 44 and the second motor 46 are electrical motors in the illustrated embodiment. Other types of motors could be employed. With reference to FIG. 3, the location of the first grinding wheel 72 with respect to the ground metal part 12 and the location of the second grinding wheel 92 with respect to the ground metal part 12 can be adjusted in an axial direction. For example, rotation of the first handle 58 in a clockwise direction can result in the motor adjustment drive 52 moving the motor mount 50 toward the frame plate 20, and rotation of the handle 58 in a counterclockwise direction can result in movement of the motor mount 50 away from the frame plate 20. Similarly, rotation of the handle 88 in a clockwise direction can result in the second motor adjustment drive 82 moving the second motor mount 80 toward the frame plate 20. Also, rotation of the handle 88 in a counterclockwise direction can result in movement of the motor mount 80 away from the frame plate 20. With reference to FIG. 3, the location of the first grinding wheel 72 with respect to the ground metal part 12 can be adjusted in an axial direction as depicted by arrow 194, which is parallel with the rotational axis 78. Likewise, location of a second grinding wheel 92 with respect to the ground metal part 12 can be adjusted along an axis 196, which is parallel with the rotational axis 98 of the second motor 46.

Movement in the direction of arrow 194 or in the direction of arrow 196 can be accomplished either manually (by rotating the respective handles 58, 88) or automatically through the use of the controller 42 (FIG. 1). The controller 42 can also operate to measure an amperage load of each of the motors 44, 46. With reference back to FIG. 6, while each grinding wheel is rotating in a clockwise direction, at 154, the controller 42 can be measuring the amperage load of each motor 44, 46 and, at 200, determine whether the amperage load is within a predetermined range. If it is determined, at 200, that the amperage load is within the predetermined range, then each wheel continues to rotate in a clockwise direction, at 154. If it is determined that the amperage load is outside the predetermined range, either too low or too high, adjustment of the grinding wheel 72, 92 with respect to the ground metal part 12 can be performed, at 202. This adjustment can be performed by way of the first motor adjustment drive 52 adjusting the first motor 44 or the second motor adjustment drive 82 adjusting the second motor 46. Similarly, while each grinding wheel 72, 92 is rotating in the counterclockwise direction, at 156, the controller 42 can take measurements to determine whether the amperage load of each motor 44, 46 is within the predetermined range. If the amperage load is found to be within the predetermined range, at 204, then rotation of each grinding wheel continues, at 156. If the amperage load is outside of the predetermined range, then adjustment of the grinding wheel 72, 92 can be accomplished, at 206, and then each grinding wheel 72, 92 continues to grind the ground metal part 12 while rotating in a counterclockwise direction, at 156. For example, if the amperage load on one of the motors 44, 46 is measured to be too high, then the respective grinding wheels 72, 92 can be moved away from the ground metal part 12.

Rotating each of the grinding wheels in a clockwise direction, then in a counterclockwise direction, and repeating this clockwise to counterclockwise pattern allows the distal ends of each of the bristles 76, 96 to dig into the recesses 134 of the ground metal part 12 to remove any burrs that may reside therein. This results in a much cleaner ground metal part 12 for use in a machine, such as like a hydraulic motor. Also, the amperage on each of the motors 44, 46 can be measured and the location of the grinding wheels 72, 92 with respect to the ground metal part 12 can be adjusted to ensure that adequate force is being applied to the ground metal part 12.

Figure 7:
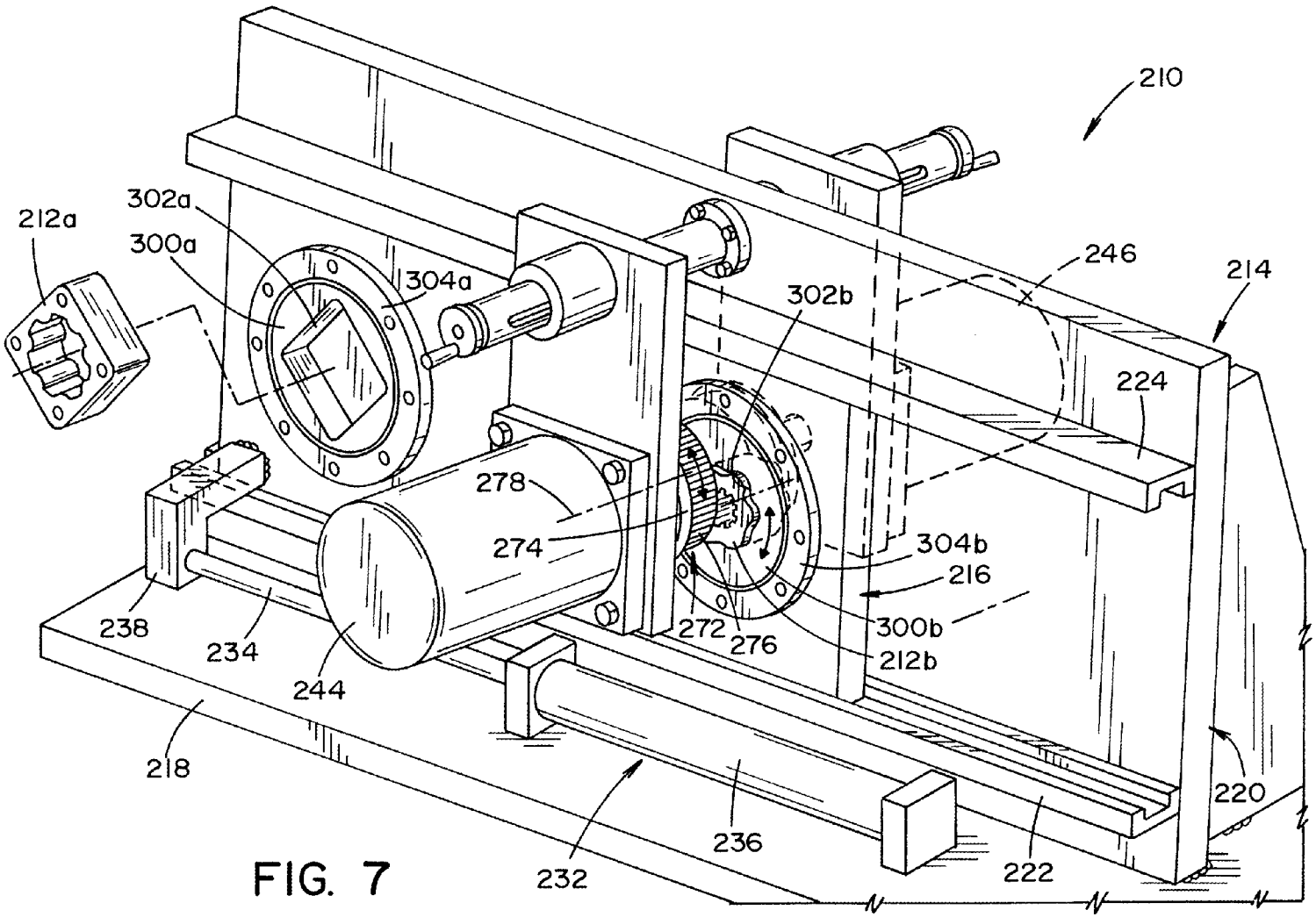
FIGS. 7 and 8 are schematic perspective views of another deburring machine for use in a method for deburring a ground metal part.

FIG. 7 depicts another deburring machine 210 for deburring a ground metal part: two ground metal parts 212*a*, 212*b* are depicted. The deburring machine 210 includes a frame 214, which is similar to the frame 14 described above, and a carrier 216, which is similar to the carrier 16 described above. The carrier 216 is moveable with respect to the frame 214. The deburring operation is performed after the ground metal parts 212*a*, 212*b* have been ground in a grinding machine (not shown), which can result in the formation of burrs on the ground metal parts. The deburring machine 210 is used to remove these burrs from the ground metal parts 212*a*, 212*b* after the ground metal parts 212*a*, 212*b* have already been ground in the grinding machine.

Figure 8:
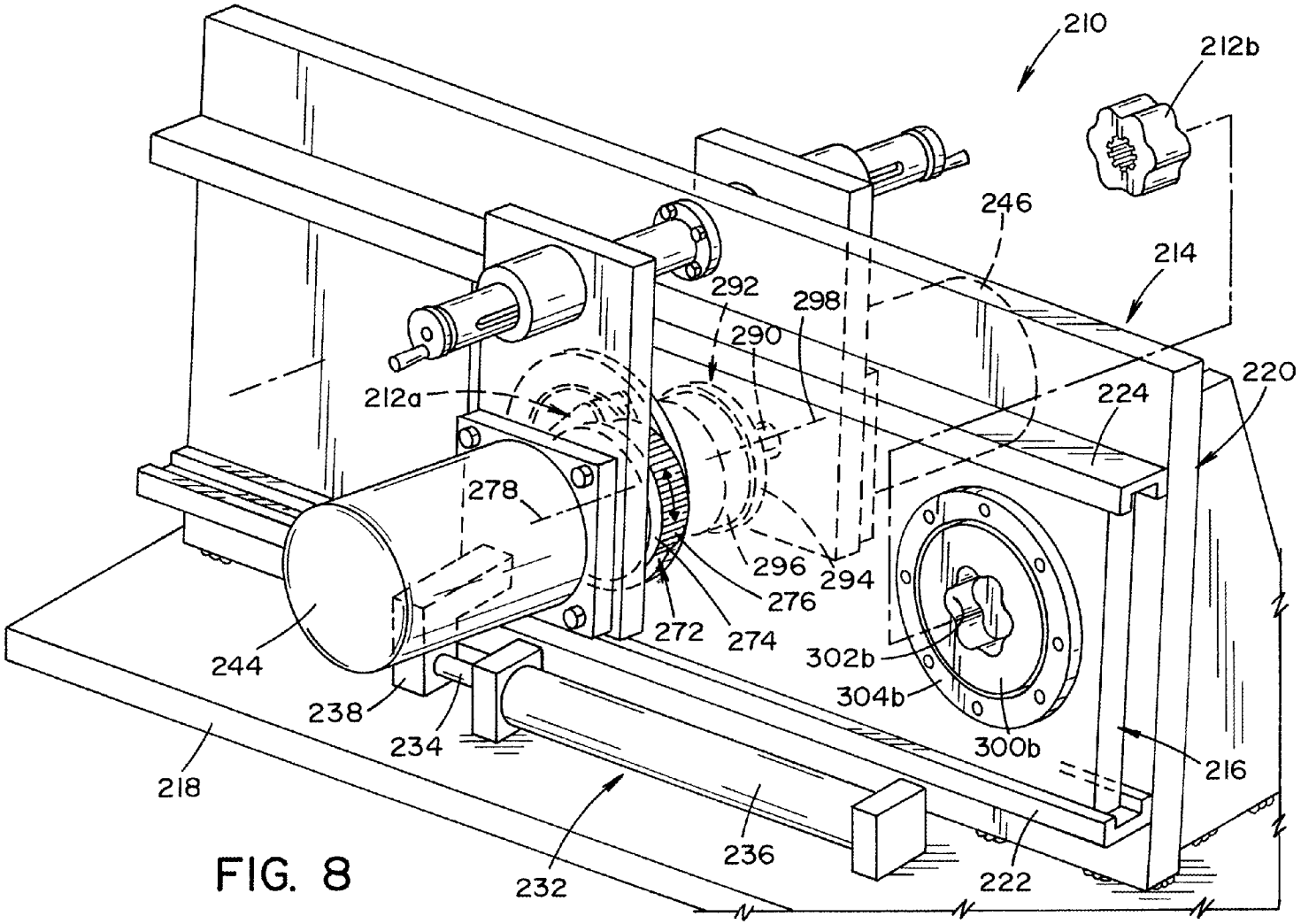
Figure 9:
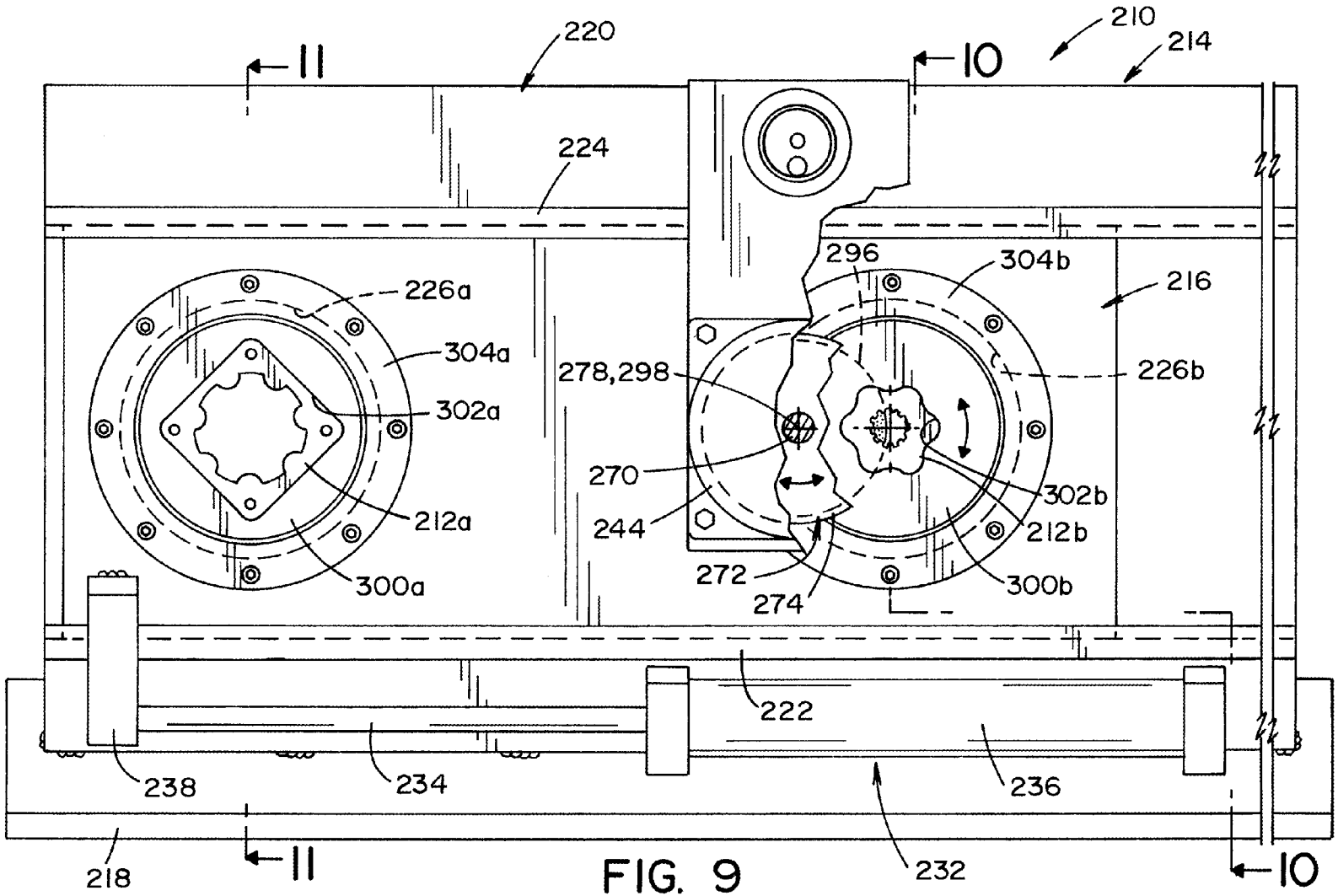
FIG. 9 is a view of the deburring machine shown in FIGS. 7 and 8 from a perspective similar to that shown in FIG. 4.
Figure 10:
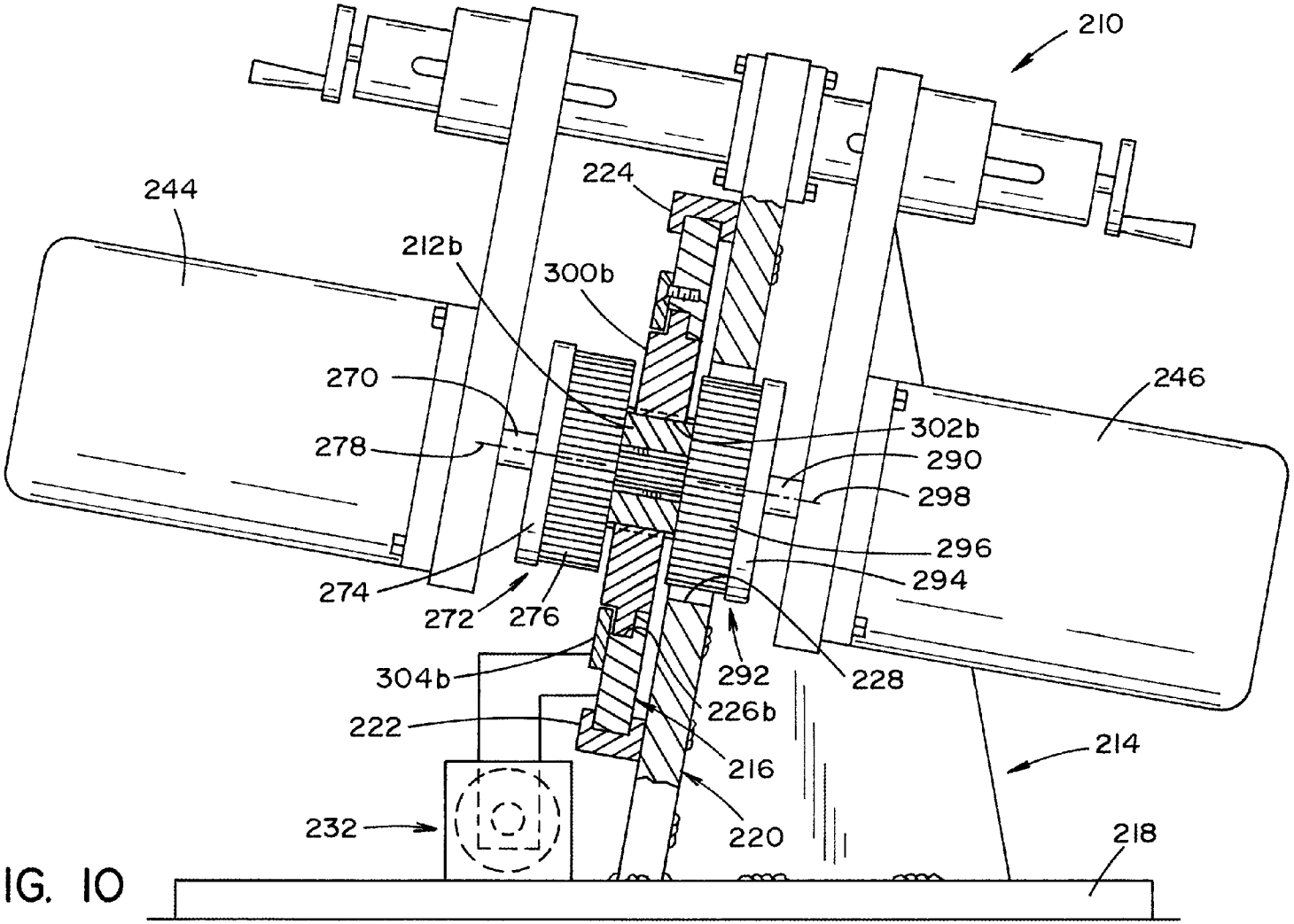
FIG. 10 is a cross-sectional view taken along line 10-10 in FIG. 9.
Figure 11:
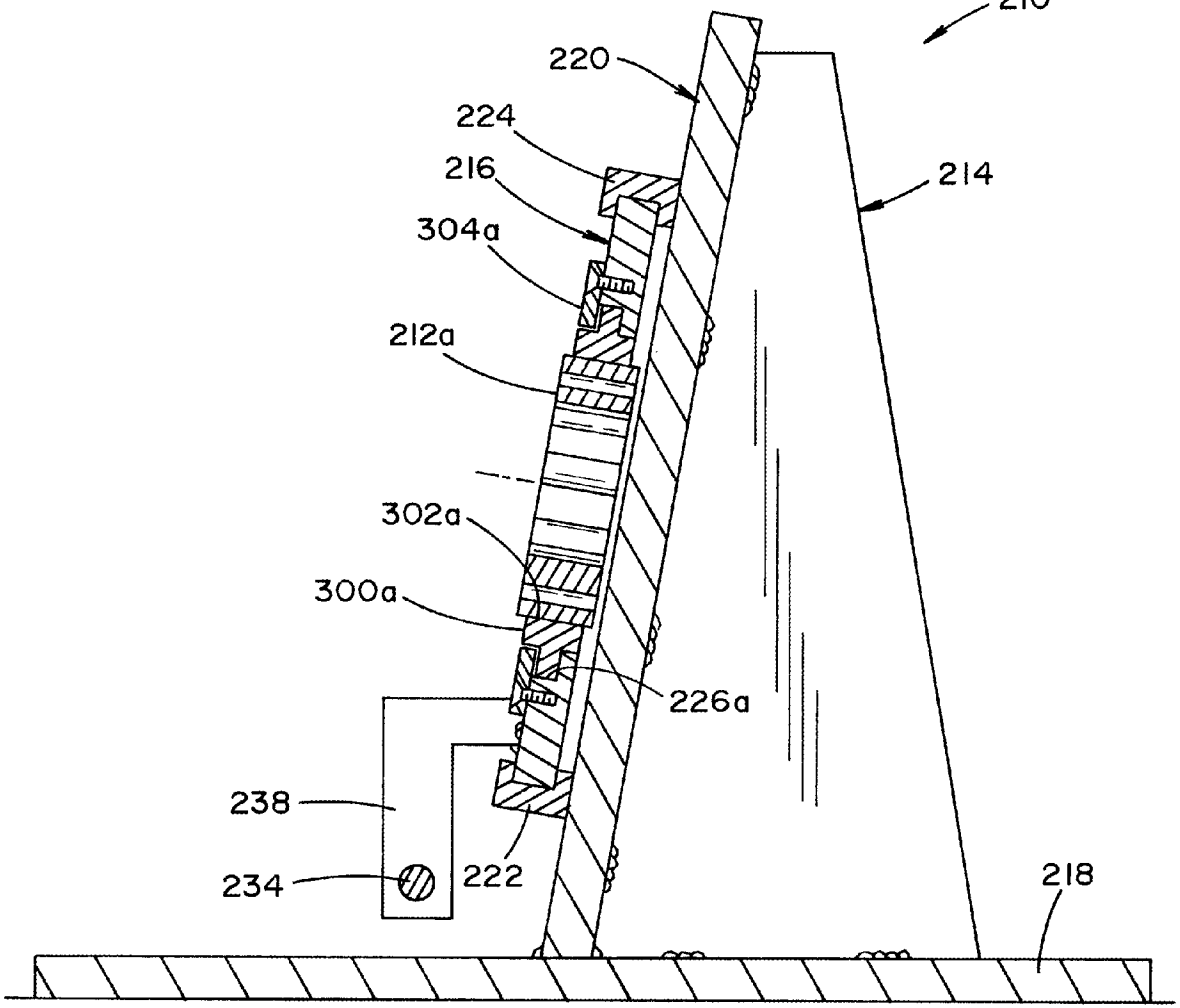
FIG. 11 is a cross-sectional view taken along line 11-11 in FIG. 9.

The frame 214 of the deburring machine 210 is very similar to the frame 14 described above and includes a base 218 and an upwardly extending frame plate 220. A lower rail 222 and an upper rail 224 connect with and are fixed to the frame plate 220. The carrier 216 rides along the rails 222, 224 offset from the frame plate 220. The carrier 216 translates between a first position (shown in FIG. 7) and a second position (shown in FIG. 8).

The carrier 216 includes circular openings 226*a*, 226*b* that each extend entirely through the carrier 216. The frame plate 220 also includes an opening 228. When the carrier 216 is in the first position (shown in FIG. 7) the first opening 226*a* formed in the carrier 216 overlaps with the opening 228 formed in the frame plate 220. When the carrier 216 is in the second position (shown in FIG. 8), the second opening 226*b* overlaps with the opening 228 formed in the frame plate 220.

A carrier drive 232 is provided to move the carrier 216 with respect to the frame 214. The carrier drive 232 includes a rod 234 and a cylinder 236, and an arm 238 connects the rod 234 to the carrier 216. A controller (not shown, but similar to the controller 42) controls operation of the carrier drive 232. The carrier drive 232 is similar in configuration to the carrier drive 32 described above; therefore, further description has been omitted.

The deburring machine 210 also includes a first motor 244 positioned on a first side of the frame plate 220 and a second motor 246 positioned on an opposite side of the frame plate 220. Each of the motors 244, 246 is in communication with the controller (not shown) to control operation (e.g., ON/OFF, rotational direction) of the motors 244, 246, and each of the motors 244, 246 can adjust with respect to the frame plate 220 similar to the motors 44, 46 described above. As such, further description of the adjustment of the motors 244, 246 is omitted.

A first grinding wheel 272, which includes a circular base 274 and a plurality of bristles 276 extending from the circular base 274, attaches to an output shaft 270 of the first motor 244. The first grinding wheel 272 rotates about a first rotational axis 278 (clockwise or counterclockwise) when the first motor 244 is ON. The second motor 246 includes an output shaft 290 that connects with a second grinding wheel 292. The second grinding wheel 292 includes a circular base 294 and a plurality of bristles 296 that extend from the circular base 294. The second grinding wheel 292 rotates about a second rotational axis 298 (clockwise or counterclockwise) when the second motor 246 is ON.

With reference FIG. 7, the carrier 216 is shown in a position that locates the second ground metal part 212*b* in an appropriate location for deburring the second ground metal part 212*b*. In this position, the first grinding wheel 272 and the second grinding wheel 292 contact the second ground metal part 212*b*. In the position shown in FIG. 7, the first ground metal part 212*a* can be loaded into or unloaded from the deburring machine 210. With reference FIG. 8, the carrier 216 is shown in a position that locates the first ground metal part 212*a* in an appropriate location for deburring the first ground metal part 212*a*. In this position, the first grinding wheel 272 and the second grinding wheel 292 contact the first ground metal part 212*a*. In the position shown in FIG. 8, the second ground metal part 212*b* can be loaded into or unloaded from the deburring machine 210. As such, one part 212*a* can be brushed while the other part 212*b* is being unloaded.

The method for deburring a ground metal parts 212*a*, 212*b* can follow the method described above with reference to the flowchart depicted in FIG. 6. The deburring machine 210 differs from the deburring machine 10 depcited in FIG. 1 in that the carrier 216 includes two circular openings 226*a* and 226*b*. Inserts 300*a*, 300*b* can be placed in each respective opening 226*a* and 226*b*. Each of the inserts 300*a*, 300*b* is circular in configuration and has a diameter on slightly smaller than the respective opening 226*a*, 226*b* that receives the insert. The first insert 300*a* includes a bore 302*a* that has a profile similar to a stator of a conventional hydraulic gerotor motor. As such, when the first ground metal part 212*a* is a stator, the stator can be received in the first insert 300*a*. The second insert 300*b* includes a bore 302*b* that has a profile similar to a rotor of a conventional hydraulic gerotor motor. As such, when the second ground metal part 212*b* is a rotor, the rotor can be received in the second insert 300*b*. A first ring 304*a* retains the first insert 300*a* in the first opening 226*a* in the carrier 216. Similarly, a second ring 304*b* retains the second insert 300*b* in the second opening 226*b* in the carrier 216.

The deburring machine 210 allows for the rotor and the stator to be brushed together. When manufacturing a gerotor motor, the rotor and the stator make up a rotor set of the motor. Each rotor is matched to a particular stator and vice versa. It is desirable that the rotor that is matched to the stator be brushed with the stator with which it has been matched. The deburring machine 210 allows for this by providing the two openings 226*a*, 226*b* in the carrier 216. This also speeds processing.

A method for deburring a ground metal part and a machine for use in such a method has been described above with particularity. Modifications and alterations will occur to those upon reading and understanding the preceding detailed description. The invention, however, is not limited to only those embodiments described above. Instead, the invention is broadly defined by the appended claims and the equivalents thereof. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for deburring a ground metal part, the method comprising:

loading a ground metal part into a first circular opening in a carrier of a deburring machine, wherein the carrier also includes a second circular opening;

contacting a first planar surface of the ground metal part with a first grinding wheel;

contacting a second planar surface, which is opposite to and parallel with the first planar surface, of the ground metal part with a second grinding wheel;

with the first grinding wheel in contact with the first planar surface, rotating the first grinding wheel in a first rotational direction about a first rotational axis, which is parallel to and offset from a first central axis of the first circular opening in the carrier;

with the second grinding wheel in contact with the second planar surface, rotating the second grinding wheel in the first rotational direction about a second rotational axis, which is parallel to and offset from the first central axis;

with the first grinding wheel in contact with the first planar surface, rotating the first grinding wheel in a second rotational direction, which is opposite to the first rotational direction, about the first rotational axis;

with the second grinding wheel in contact with the second planar surface, rotating the second grinding wheel in the second rotational direction about the second rotational axis;

wherein the second circular opening defines a second central axis;

wherein subsequent to loading the ground metal part and prior to contacting the first planar surface, the carrier is translated along a rail of the deburring machine so that the first central axis and the second central axis remain vertically spaced from the rail a first distance and a second distance, respectively; and wherein the first distance is equal to the second distance.

2. The method of claim 1, wherein rotating the first grinding wheel and the second grinding wheel in the first rotational direction with each grinding wheel in contact with the ground metal part results in the ground metal part rotating in the second rotational direction about the central axis with respect to the carrier.

3. The method of claim 1, wherein each grinding wheel is a brush including a plurality of bristles, each bristle extending in a direction parallel with the respective rotational axes.

4. The method of claim 3, wherein the ground metal part includes a recess extending axially into the ground metal part from the first planar surface, wherein the bristles of the brush of the first grinding wheel extend into the recess while the first grinding wheel is rotating and in contact with the first planar surface.

5. The method of claim 1, further comprising moving the first grinding wheel toward the ground metal part in a direction parallel to the first rotational axis, wherein the first grinding wheel is driven by a first motor to rotate the first grinding wheel and the second grinding wheel is driven by a second motor to rotate the second grinding wheel.

6. The method of claim 5, further comprising:

measuring an amperage load of the first motor; and adjusting a location of the first grinding wheel with respect to the ground metal part in the direction parallel to the first rotational axis based on the measured amperage load.

7. The method of claim 1, wherein the first rotational axis is coaxial with the second rotational axis, and each rotational axis is generally horizontal.

8. The method of claim 7, wherein the ground metal part is circular in a cross section taken normal to the central axis and is slightly smaller in diameter than the diameter of the first circular opening in the carrier.

9. The method of claim 1, wherein rotation of the first grinding wheel and the second grinding wheel in the first direction occurs prior to rotation of the first grinding wheel and the second grinding wheel in the second direction.

10. The method of claim 9, further comprising:

with the first grinding wheel in contact with the first planar surface, rotating again the first grinding wheel in the first rotational direction after rotating the first grinding wheel in the second rotational direction; and with the second grinding wheel in contact with the second planar surface, rotating again the second grinding wheel in the first rotational direction after rotating the second grinding wheel in the second rotational direction.

11. The method of claim 10, further comprising:

with the first grinding wheel in contact with the first planar surface, rotating again the first grinding wheel in the second rotational direction after rotating again the first grinding wheel in the first rotational direction;

with the second grinding wheel in contact with the second planar surface, rotating again the second grinding wheel in the second rotational direction after rotating again the second grinding wheel in the first rotational direction.

12. The method of claim 1, further comprising unloading another ground metal part from the carrier while contacting the first planar surface of the ground metal part with the first grinding wheel and contacting the second planar surface of the ground metal part with the second grinding wheel.

13. The method of claim 12, wherein the ground metal part is a rotor and the other ground metal part is a stator, wherein the rotor is matched to the stator and each form part of a rotor set of a gerotor motor.

14. The method of claim 1, wherein the first grinding wheel and the second wheel rotatably contact the ground metal part so that the ground metal part rotates within the first circular opening of the carrier.

15. The method of claim 14, wherein the carrier is stationary while the ground metal part rotates within the first circular opening.

16. The method of claim 1, wherein the first distance and the second distance remain constant as the carrier is moved along the rail.

17. A method for deburring a ground metal part, the method comprising:

loading a ground metal part into a circular opening in a carrier of a deburring machine;

moving the carrier along a rail of the deburring machine so as to align the circular opening of the carrier with an opening in a frame plate of the deburring machine;

contacting a first planar surface of the ground metal part with a first grinding wheel;

extending a second grinding wheel through the opening in the frame plate so as to contact a second planar surface of the ground metal part, wherein the second planar surface is opposite to and parallel with the first planar surface;

with the first grinding wheel in contact with the first planar surface, rotating the first grinding wheel in a first rotational direction about a first rotational axis, which is parallel to and offset from a central axis of the circular opening in the carrier;

with the second grinding wheel in contact with the second planar surface, rotating the second grinding wheel in the first rotational direction about a second rotational axis, which is parallel to and offset from the central axis;

with the first grinding wheel in contact with the first planar surface, rotating the first grinding wheel in a second rotational direction, which is opposite to the first rotational direction, about the first rotational axis; and with the second grinding wheel in contact with the second planar surface, rotating the second grinding wheel in the second rotational direction about the second rotational axis.

18. The method of claim 17, wherein the first grinding wheel and the second wheel rotatably contact the ground metal part so that the ground metal part rotates within the circular opening of the carrier.

19. The method of claim 18, wherein the carrier is stationary while the ground metal part rotates within the circular opening.

* * * * *